US007326926B2

(12) United States Patent
Wang

(10) Patent No.: US 7,326,926 B2
(45) Date of Patent: Feb. 5, 2008

(54) CORONA DISCHARGE IONIZATION SOURCES FOR MASS SPECTROMETRIC AND ION MOBILITY SPECTROMETRIC ANALYSIS OF GAS-PHASE CHEMICAL SPECIES

(76) Inventor: Yang Wang, 7 Black Bear La., Westford, MA (US) 01886

( * ) Notice: Subject to any disclaimer, the term of this patent is extended or adjusted under 35 U.S.C. 154(b) by 290 days.

(21) Appl. No.: 11/175,535

(22) Filed: Jul. 6, 2005

(65) Prior Publication Data

US 2007/0007448 A1 Jan. 11, 2007

(51) Int. Cl.
*H01J 49/10* (2006.01)

(52) U.S. Cl. ..... 250/288; 250/423 R; 250/424; 250/324; 264/22; 422/907; 436/173

(58) Field of Classification Search ..... None
See application file for complete search history.

(56) References Cited

U.S. PATENT DOCUMENTS

| | | | | |
|---|---|---|---|---|
| 5,038,036 | A * | 8/1991 | Kouguchi et al. | 250/324 |
| 6,225,623 | B1 * | 5/2001 | Turner et al. | 250/286 |
| 7,112,785 | B2 * | 9/2006 | Laramee et al. | 250/288 |
| 2007/0113530 | A1 * | 5/2007 | Morozov et al. | 55/527 |

* cited by examiner

*Primary Examiner*—Jack I. Berman
*Assistant Examiner*—Zia R. Hashmi

(57) ABSTRACT

A corona discharge mass spectrometer or an ion mobility spectrometer is provided with a robust corona discharge ionization source. The corona discharge ionization source, which can be operated at atmospheric pressures or at low vacuum, includes a multi-thread electrode and plane electrode. The multiple thread electrode has multiple discharge tips which provide redundancy, and improve ionization stability and the reliability and efficiency of the ionization source.

19 Claims, 6 Drawing Sheets

CORONA DISCHARGE IONIZATION SOURCES FOR MASS SPECTROMETRIC AND ION MOBILITY SPECTROMETRIC ANALYSIS OF GAS-PHASE CHEMICAL SPECIES

FIELD OF THE INVENTION

The present invention relates to corona discharge ionization sources. The invention, in particular, relates to corona discharge ionization sources that are used for mass spectrometric and ion mobility spectrometric analysis of gas-phase chemical species.

BACKGROUND OF THE INVENTION

A corona discharge is an electrical discharge characterized by a corona and occurring when one of two electrodes placed in a gas (i.e. a discharge electrode) has a shape causing the electric field on its surface to be significantly greater than that between the electrodes. The two electrodes are generally asymmetric. A discharge electrode, which has a low radius or high curvature, may be shaped as a sharp needlepoint or narrow wire. The passive electrode, which has a much larger radius or lower curvature, e.g. a flat plate or cylinder, is electrically grounded. The high curvature ensures a high potential gradient around the discharge electrode for the generation of localized plasma. Corona discharges are usually created in gas held at or near atmospheric pressure though in some instances they can be created in low vacuum. The discharge electrode is held at a high voltage. The corona discharge appears as a luminous glow located in space around the discharge electrode, for example, in a highly nonuniform electric field around the needle point-tip. See e.g., R. S. Sigmond and M. Goldman, "Corona discharge physics and applications" in Electrical Breakdown and Discharges in Gases, E. E. Kunhardt and L. H. Luessen, Eds. New York, Plenum (1983), pp. 1-64, Y. P. Raizer, Gas Discharge Physics, New York, Springer-Verlag (1991), J. M. Meek and J. D. Craggs, Electrical Breakdown of Gases. London, U.K., Oxford Univ. Press (1953), L. B. Loeb, Electrical Coronas, Berkeley, Los Angeles, Calif., Univ. California Press, (1965).

The generation and the characteristics of a corona discharge are highly dependant on geometry of the discharge electrode. Electric field intensity is higher around the surface of a charged conductor or discharge electrode, which has a low geometrical radius (i.e. high curvature). Therefore, in general, the needle point-tip of the discharge electrode is made to have the smallest radius (i.e. the highest curvature) than other surface part of the electrode. If Q is the total charge stored in a needle conductor and R is its radius of the needle point-tip, the electric field intensity E at a distant r, at least approximately, is given by the following equation:

$$E=Q/(4\pi\,\epsilon_0\,r),$$

where $\epsilon_0(=8.852\times10^{-12}$ F/m) is the free space permittivity and where r>R.

Therefore, as the radius R of the needle point-tip decreases, the intensity of the electric field increases around the needle point-tip. The electric field is inhomogeneous. The corona discharge is most likely to occurs around the needle point-tip of the discharge electrode.

Corona discharge may be positive or negative according to the polarity of the voltage applied to the higher curvature electrode i.e. the discharge electrode. If the discharge electrode is positive with respect to the flat electrode, the discharge is a positive corona, if negative the discharge is a negative corona. The physics of positive and negative corona are strikingly different.

A positive corona can be viewed as two concentric regions around the discharge electrode. The inner region contains ionizing electrons and positive ions, which form a plasma. In the plasma, an avalanche of electrons generates further ion/electron pairs. The outer region, which is known as the unipolar region, consists almost entirely of slow-moving massive positive ions, which migrate toward the lower curvature electrode.

In contrast, a negative corona can be divided into three radial regions around the sharp discharge electrode. In the innermost region, which is known as the ionizing plasma region, high-energy electrons inelastically collide with neutral atoms/molecules and cause avalanches, whilst outer electrons, usually of a lower energy, combine with neutral atoms/molecules to produce negative ions. In the intermediate region, which is known as the non-ionizing plasma region, the electrons combine to form negative ions, but typically have insufficient energy to cause avalanche ionization. However, the electrons but remain part of a plasma owing to the different polarities of the species present, and their ability to partake in characteristic plasma reactions. In the outermost region, which is known as the unipolar region, only a flow of negative ions and free electrons toward the positive electrode takes place. The inner two regions (i.e. the ionizing and non-ionizing plasma regions) are together known as the corona plasma. A negative corona can be sustained only in gases having electronegative molecules, which can capture free electrons.

Notably, the positive and negative coronas differ in the matter of the generation of secondary electron avalanches,. In a positive corona, the gas surrounding the plasma region generates the secondary electron avalanches with newly generated secondary electrons traveling inward. In contrast, in a negative corona, the discharge electrode itself generates the secondary electron avalanches with the newly generated secondary electrons traveling outward.

Corona discharges can occur in a wide pressure range from the low vacuum to high pressure, including atmosphere. A high direct current (DC) voltage can generate a corona discharge. Alternatively, an alternating current (AC) voltage, which may be a sinusoidal or a pulsed voltage, may be used to generate a corona discharge. The onset voltage of corona (i.e., the Corona Inception Voltage (CIV)) may be determined by reference to the empirical Peek's law (1929). Corona discharges are more intense at higher frequencies of AC voltage. Corona discharges occur at high electric field intensities, which are lower than the dielectric strength of the medium. Thus, corona discharges may be characterized as a high voltage, low current, and low power discharge with a low intensity photoemission. Typically, corona discharges dissipate at most a few watt of power and often only a few milliwatts or less.

Applying a voltage across two electrodes induces corona discharges. If one of the electrodes is made with a lower radius of curvature compared to the other, a unipolar corona is generated, as in this case the corona discharge is almost entirely concentrated around the electrode with the higher curvature, i.e. the discharge electrode. In the corona discharge, a plasma is created around the discharge electrode. For a point-to-plane corona, the electrode is usually a metal needle made of material such as stainless steel. The tip of the needle is sharpened to a cone shape having a tip radius of about a few to a few hundreds micrometers, and the plane electrode separated from the tip by a distance of a few to a few tens of mm. The plasma usually exists in a region of the gas extending about 0.5 mm away from the metal needle point-tip. In the unipolar region outside this plasma region, charged species diffuse toward the plane electrode.

Corona discharges have commercial and industrial applications. In particular, corona discharges have been used as ionization sources in Mass Spectrometer (MS) and Ion Mobility Spectrometer (IMS) applications that are used to detect the chemical species in the gas phase. Mass spectrometers are analytical instruments that are designed for measuring mass-to-charge ratio (m/z) of gas-phase ions in a vacuum chamber. Specific types of mass spectrometers include, for example, quadrupole mass filter, quadrupole ion trap mass spectrometer (QIT) and linear ion trap mass spectrometers. These spectrometers utilize the stability or instability of ion trajectories in a dynamic electric field to separate ion according to ions' mass-to-charge ratio. Another specific type of mass spectrometer is the time-of-flight mass spectrometer (TOF). In a TOF mass spectrometer, the mass ions are repelled or pushed into a field-free flight tube, and separated and identified based on their different flight time due to their different mass-to-charge ratios. Mass spectrometers when interfaced with gas chromatograph (GC) or liquid chromatograph (LC) become a powerful analytical instrument GC-MS and LC-MC. There are many different types of ionization sources that are commonly used in mass spectrometers (e.g., electron ionization (EI) and electrospray ionization (ESI) sources). However, the use of corona discharge as an ion source is attractive due to its simplicity and the possibility of atmospheric pressure ionization.

Ion mobility spectrometers (IMS) like mass spectrometers are analytical instruments designed for gas-phase analysis and are used as detectors in gas chromatography. In these spectrometers, ions are separated at ambient pressure in according to their individual velocities as they drift through an inert gas driven by an electric field. The ionization source in conventional IMS is a radioactive nickel (63 Ni) source, which provides beta emission ionization. The radioactivity of the source necessitates complicated handling and safety procedures to avoid leaks. These limitations, together with the problems associated with licensing and waste disposal, has limited the acceptance of IMS in the market place. Like the case of mass spectrometers, the use of corona discharges in IMS is attractive due to its simplicity.

Corona discharges, which are designed for use in mass spectrometers, are described, for example, by U.S. Pat. Nos. 3,621,241, 4,144,451, 4,667,100, 4,023,398, and 5,070,240. Similarly, U.S. Pat. Nos. 6,822,225, 6,225,623, 6,407,382 and 5,684,300 describe the use of corona discharge ionization sources in IMS applications. Corona discharges also have been used in Atmospheric Pressure Chemical Ionization source (APCI) Mass Spectrometers, which measure chemical species in liquid-phase.

The corona discharge ionization sources used in MS or IMS generally have a simple point-to-plane geometry. The "point" electrode is a metal needle with a sharp point-tip. However, despite several years of development work, the corona discharge sources designed for MS or IMS instruments lack stability and reliability. Firstly, this type of point-to-plane geometry source is not an efficient ionization source for IMS and MS applications because the plasma region of the corona discharge is an extremely small volume around the point-tip, compared to the source chamber volume. The overall detection sensitivity of an IMS or MS instrument is proportional to the ionization efficiency. The lower ionization efficiency results in the lower detection sensitivities. Further, any defect of the needle point-tip (e.g. heating of an unexpected spark or long-term electrochemical effects to the electrode material) increases the point-tip radius, which makes the corona unstable and degrades ion-mass detection capability. Thus, conventional corona discharge ionization sources do not provide robust ionization sources for MS and IMS applications.

Consideration is now being given to new designs of corona discharge ionization sources for mass spectrometer, ion mobility spectrometer and other applications. Attention is paid to improving the performance characteristics including the reliability and stability of the corona discharge ionization sources. In particular, attention is directed to the point-to-plane geometry and to the configuration of the electrodes that are used to generate the corona discharge for mass spectrometer and ion mobility spectrometer applications.

SUMMARY OF THE INVENTION

Corona discharge ionization sources, which are suitable for mass spectrometers or ion mobility spectroscopy are provided. The corona discharge ionization sources utilize especially structured discharge electrodes, which are fabricated from a bundle of metallic threads or multi-threads. The multiple threads or multi-thread structure of the electrodes improves the ionization efficiency, stability and reliability of the corona discharge ionization sources. The corona discharge ionization sources may be operated by application of either DC or AC voltage, and operated in an ambient that is at or near atmosphere pressure. Alternatively, the corona discharge terminal can be sealed and operated in a low vacuum arrangement.

Another corona discharge ionization source, which is designed according to the present for mass spectrometers or ion mobility spectrometer applications, includes an electrode arrangement in which a metallic or electrically isolated tube encloses the multi-threaded structure.

In one configuration, this corona discharge ionization source is operated in a gas flow at or near atmospheric pressures. A gas with gas-phase chemical species flows through the enclosing tube, along the multi-threaded electrode structure. The gas flow may be driven by a motor fan or a small suction pump. In this configuration, the gas flow moves the gas-phase chemical species through the corona discharge region or plasma. As a result this movement, ionization of the chemical species can be fast and efficient.

In another configuration designed for low-vacuum or low-pressure operation, the tube enclosing the multi-threaded electrode structure may be disposed in a vacuum or low-pressure arrangement at one end. The discharge end of the multi-threaded electrode structure extends through the tube, and is also disposed in low vacuum. The low pressures or vacuum may be generated by a suitable vacuum pump. The other end of the tube may be held at atmosphere pressure. The pressure gradient between the two ends of the tube forces gas with gas-phase chemical species to flow through tube along the multi-threaded electrode structure. Again, the movement of the gas-phase chemical species through the corona discharge region or plasma causes the ionization of the chemical species to be fast and efficient.

In further configurations, the inventive corona discharge ionization sources are designed for use in ion trap mass spectrometers (IT-MS) or linear ion trap mass spectrometers (LIT-MS) and time-of flight mass spectrometers (TOF-MS) and gas chromatograph mass spectrometers (GC-MS) and mass spectrometers or ion mobility spectrometers with pneumatically assisted gas-jet desorption of chemical species under investigation.

In other configurations, a dual multi-threaded corona discharge ionization sources can be designed for use in MS or IMS.

Other features, aspects, and advantages of the invention will become apparent from the description, the drawings, and the claims.

BRIEF DESCRIPTION OF THE DRAWINGS

Further features of the invention, its nature, and various advantages will be more apparent from the following detailed description of the preferred embodiments and the accompanying drawings, wherein like reference characters represent like elements throughout, and in which.

DETAILED DESCRIPTION OF THE INVENTION

Figure 1:
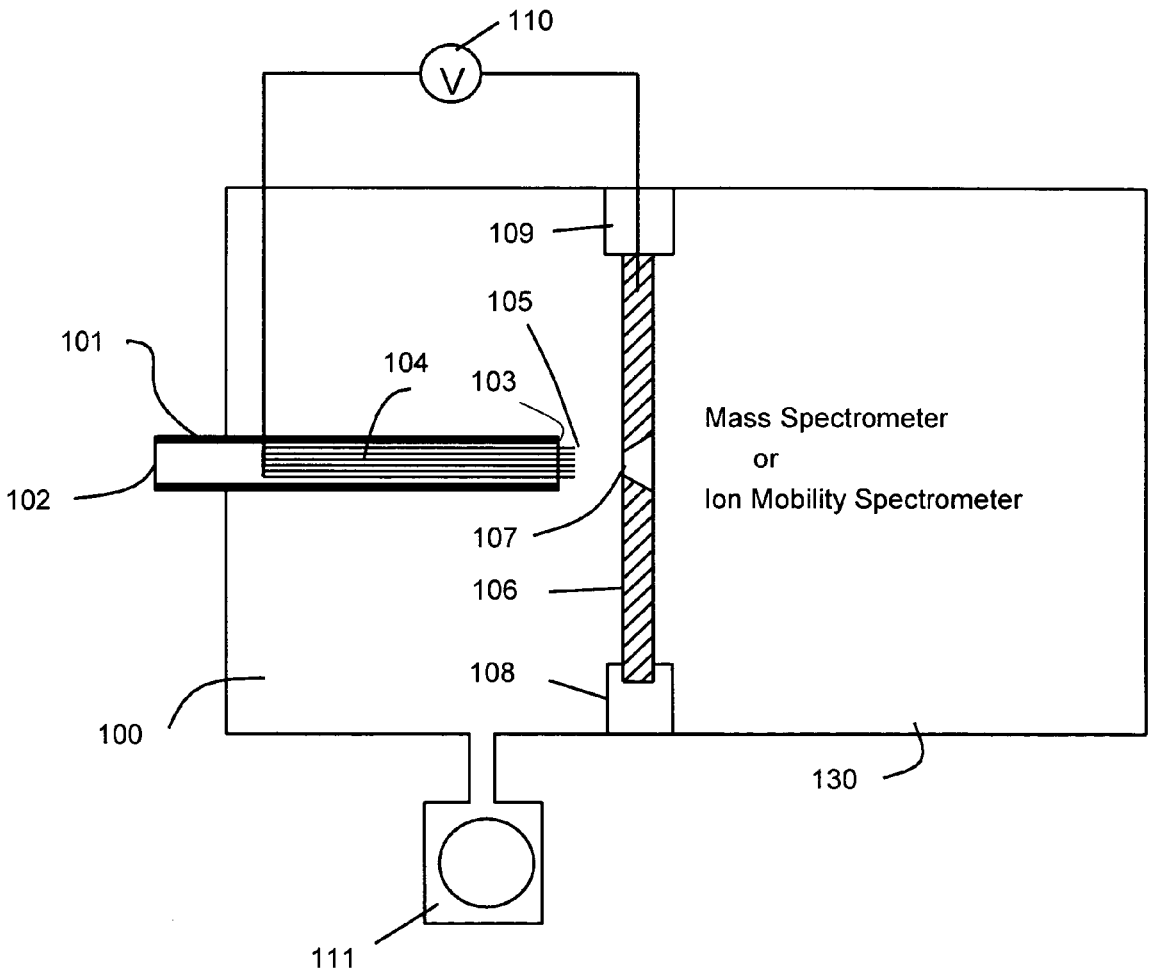
FIG. 1 is a schematic illustration representing the use of a multi-threaded corona discharge ionization source in a mass spectrometer (or ion mobility spectrometer) in accordance with the principles of the present invention.

Corona discharge ionization sources with stable, reliable and robust operational characteristics are provided. The corona discharge ionization sources utilize a discharge electrode having a multi-threaded structure. This multi-threaded discharge electrode is used in a point-to plane geometry in conjunction with a plane geometry. The multi-threaded electrodes are superior to conventional needlepoint electrodes in which a single defect in the electrode needlepoint can lead to failure or serious degradation of the corona discharge.

An exemplary discharge electrode, in accordance with the principles of the present invention, is configured with multiple discharge point tips. In this configuration failure of one or a even few tips does not degrade the corona discharge as the other tips in the electrode provide redundancy in operation.

In an electrode, the multiple discharge tips or points are disposed at the end a multiple thread structure or bundle for the discharge electrode. The multiple thread structure or bundle may be fabricated from individual small diameter metallic threads, wires or strands, which are held together in linear sections or are twisted together. Each thread or strand in multiple-thread structure or bundle may have a diameter ranging, for example, anywhere from about a few micrometers to about a few hundred micrometers. Further, each thread or strand may itself be composed of multiple sub threads, wires or strands, which have smaller diameters.

An end of each component thread in the multiple thread structure or bundle may form an effective discharge tip at one end face of the multiple-threaded structure or bundle. Thus, the number of discharge tips in the electrode may be equal to about the number of threads or strands in the multiple-threaded structure. The number of threads or strands used and their particular geometry (e.g., diameter and end shapes and radii) may be selected or designed so that each of the multiple discharge tips can create the inhomogeneous electric field potentials, which are suitable for initiating and/or sustaining a corona discharge.

Further, each thread in the multi-threaded structure can have a uniform diameter along a length of the structure. Thus, even if a thread segment is shorted due to a defect, the diameter of the thread tip's diameter remains unchanged. In conventional needle point electrodes, a shorting defect changes the needle tip diameter and causes the corona discharge to die out. In contrast, the uniform thread diameter feature of the inventive electrodes advantageously allows a multi-thread electrode to be used continuously in long term operation to initiate and sustain the corona discharges.

The number of multiple discharge tips in the multiple threaded electrode may be selected to be sufficiently high number, so that in the event one of more discharge tips are damaged or defective (e.g., during fabrication or operation) the properties of a corona discharge formed using the electrode are not significantly altered. The number of multiple discharge tips selected may, for example, be such that the ionization characteristics or yield of the corona discharge remains within acceptable tolerances for instrument applications (e.g., for mass spectrometers).

The corona discharge formed using the multi-threaded electrode is expected to be more reliable and robust than that of the single needle point-to-plane electrode geometry. The inventive discharge electrodes may be operated for considerably longer periods of time before replacement is necessary, especially compared to conventional single needle point-to-plane electrodes.

Further, the overall ionization efficiency of the multi-thread electrode can be much higher than that of conventional single needle point-to-plane electrodes. Each of the multiple discharge tips is associated with a plasma region. The total plasma region and hence the total ionization volume associated with the multi-thread electrode is proportional to the number of multiple discharge tips. The larger ionization volume associated with the multi-threaded electrode leads to larger ionization efficiencies than can be obtained using conventional single needlepoint electrodes. The high ionization efficiency of the multi-thread electrode is particularly advantageous for MS and IMS applications in which the higher efficiencies can lead to higher detection sensitivities.

FIG. 1 shows an exemplary corona discharge ionization source 100 having a multi-thread electrode 104, which is deployed for MS or IMS applications (e.g., in a spectrometer instrument 130, which may be a mass spectrometer or an ion mobility spectrometer). The mass spectrometer can be a quadrupole filter, or a quadrupole ion trap, or a linear ion trap, or time-of-flight mass spectrometer. Multi-thread electrode 104 is disposed in a tube 101. Tube 101 may be as long as a few meters or may be as short as a few millimeters. Tube 101 may be made of any suitable metal or insulating materials, for example, ceramic materials. Tube 101 has open ends 102 and 103. A "multiple discharge tips" end 105 of electrode 104 extends out of tube 101's open end 103. Tube 101 is positioned in source chamber 100 of spectrometer instrument 130 so that discharge end 105 is at a suitable distance from plane electrode 107. The latter electrode may be a metal plate, which is supported on isolation blocks 109 and 108. In some versions of the corona discharge ionization source 100, tube 101 may optionally be heated. A motor fan or suction pump 111 is connected to source volume 100. In operation, source volume 100 may be filled with a gas containing suitable chemical specie. The gas may be held at atmospheric pressures. Suction pump 111 may be activated to force a flow of the gas through tube 101 along electrode 104. A high voltage 110, which may be an AC or a DC voltage (positive or negative), is applied across electrode 104 and 108 to generate a corona discharge in the gas in source volume 100. The gas with chemical species is ionized in the plasma region of multiple discharge tips 105. These ions are injected into spectrometer instrument volume 130 through a hole 107 provided in plate 106.

In instances where spectrometer instrument volume 130 is designed for ion mobility spectrometry, the ions generated by corona discharge source 100 may be pushed through a drift tube by a high voltage pulse (not shown). In this drift tube arrangement, different ion-masses are separated as a function of drift distance according to their mobility, mass, size, shape and charged states. The ion signals are recorded. Multi-thread corona discharge ionization source 100 improves the ionization stability, reliability, robust and efficiency.

In another application, multi-threaded corona discharge ionization source 100 is operated at low vacuum. With reference to FIG. 1 the outside surface of tube 101 is vacuum-sealed. Vacuum chamber 100 is evacuated or pumped to low pressures using a vacuum pump 111 (which may replace the motor fan or small suction pump mentioned above.) The low vacuum can be, for example, about a few hundred mbar or about a few mbar. Gas carrying the chemical specie flows through tube 101 along the threads from the outside atmosphere through end 102, past multiple discharge tips 105 into source chamber 100. A voltage 110, which can be a positive or negative DC voltage or AC voltage, is applied across electrodes 104 and 106. Voltage 110 may be about a few thousand volts. When the voltage exceeds the corona ignition voltage, a corona discharge is induced at the tips of the multiple threads in electrode 104. The tips have the smallest radius compared to the other part of the electrode surface. The ions generated in the corona discharge migrate toward to plane electrode 106 and pass through central hole 107 for ion entrance to analyzer of MS or IMS 130. The gas-phase chemical spices, ionized in the corona discharge ionization source, may be analyzed, detected, recorded and displayed by ion mobility spectrometer or by the mass spectrometer which may include, for example, a quadrupole filter, a quadrupole ion trap, a linear ion trap, or time-of-flight mass spectrometer.

Figure 2:
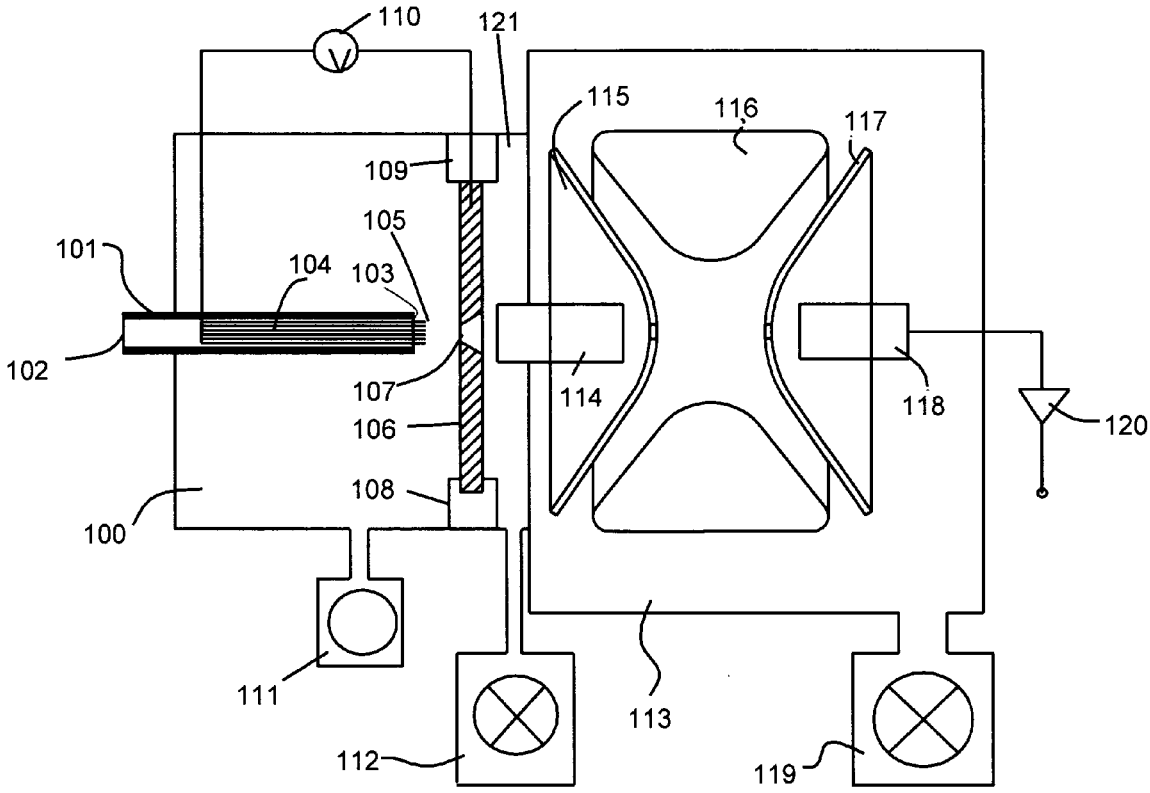
FIG. 2 is a schematic illustration of a specific corona discharge ion trap mass spectrometer having a multi-threaded corona discharge ionization source provided in accordance with the principles of the present invention.

FIG. 2. shows a version of the mass spectrometer instrument 130, which is configured as a corona discharge ion trap mass spectrometer. Source chamber 100 may either be pumped to a low vacuum by the pump 111, or held at atmospheric pressures with a gas flow through the tube 101 past the multi-thread tips driven by a motor fan or a suction pump 111. Ions are generated by corona discharge, which is initiated by applying suitable voltages across electrodes 104 and 106, as described above. The ions are focused by an electron optical lens system and/or confirmed and cooled by a RF multipole device 114 into the ion trap with two cap-electrodes 115 and 117 and a ring electrode 116. RF multipole device 114 may be an RF-only quadrupole, hexapole or octopole device. The electron optical lens system is held in the vacuum chamber 121, which is pumped by the vacuum pump 112. The trapped ions are analyzed by ion trap mass spectrometer 113. An electron multiplier or a Faraday detector 118 detects the ion signal. The detected signal is pre-amplified by amplifier 120. The ion trap and the detector are held in the vacuum chamber 113, which is pumped by the vacuum pump 119. In this application, the multi-thread corona discharge ionization source 100 improves ionization stability, reliability, robust and efficiency.

Figure 3:
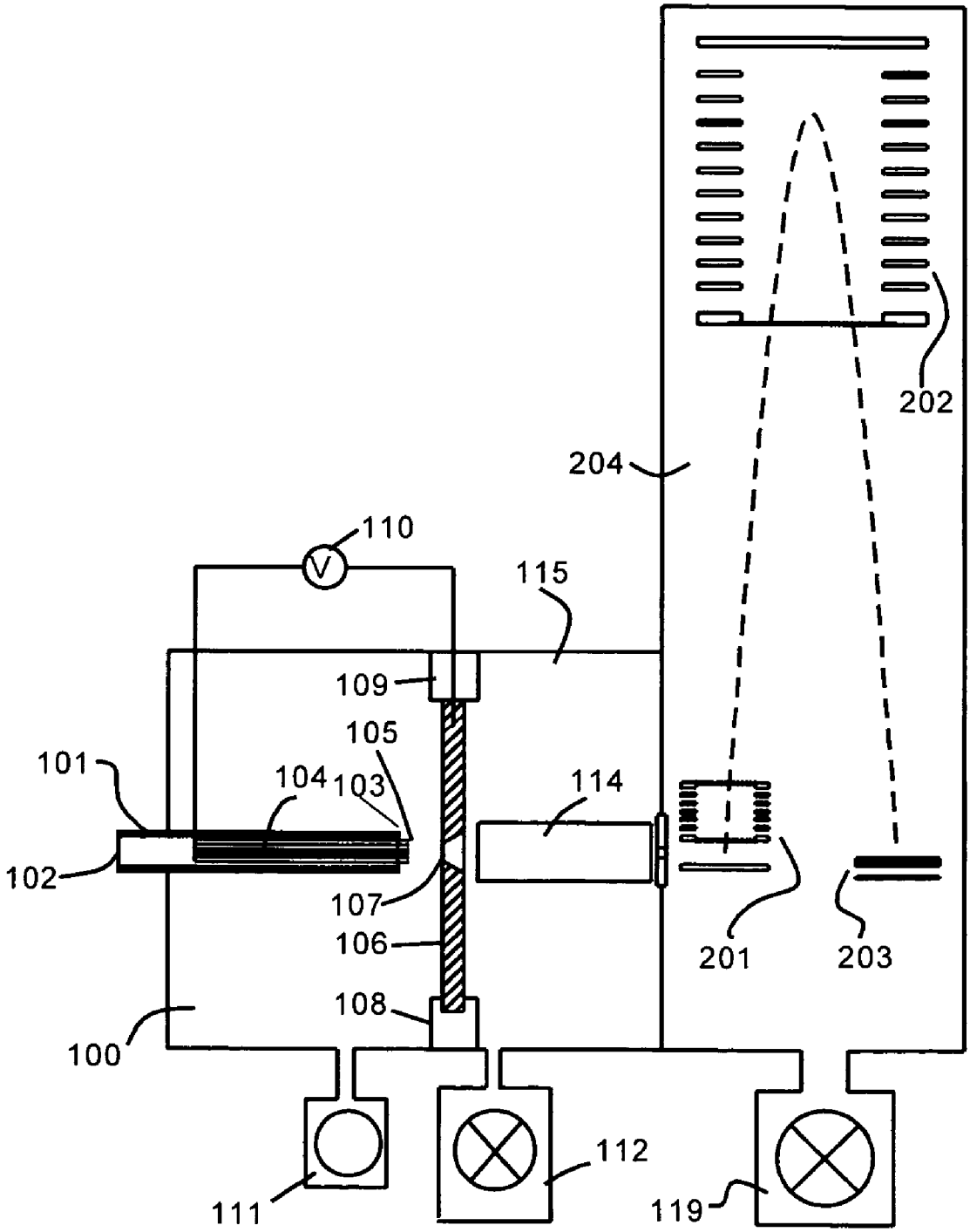
FIG. 3 is a schematic illustration of a specific corona discharge of corona discharge time-of-flight mass spectrometer with a multi-threaded corona discharge ionization source provided in accordance with the principles of the present invention.

FIG. 3. shows another version of the mass spectrometer instrument 130 of FIG. 1. In this version instrument 130 is configured as a corona discharge time-of-flight mass spectrometer. In this case, corona discharge ionization source 100 can be operated either in atmosphere or a low vacuum as described above Ions generated by corona discharge ionization are transferred through optical system 114 into a TOF tube 204, which is evacuated to low pressures by vacuum pump 119. In TOF tube 204 ions are pushed in a flight direction by a pusher device 201. The ions are reflected by a reflectron 202 and detected by a channeltron detector 203. Ions with different mass-to-charge ratios are analyzed according to their different flight times.

Corona discharge ionization source 100 may be connected to a sampling system (e.g., a gas chromatograph instrument (GC)) placed in gas inlet. In conventional gas chromatograph mass spectrometer (GC-MS), the ions are usually generated by electron impact ionization (EI). A filament in the vacuum chamber generates the electrons, which ionize the gas-phase molecules. In accordance with the present invention, corona discharge ionization source 100 is used as an ionization source to substitute the EI source for GC-MS. Corona discharge ionization source 100 can be easily interfaced between GC and mass spectrometer instrument 130, at least in part because source 100 as its can operate at atmospheric pressures.

Figure 4:
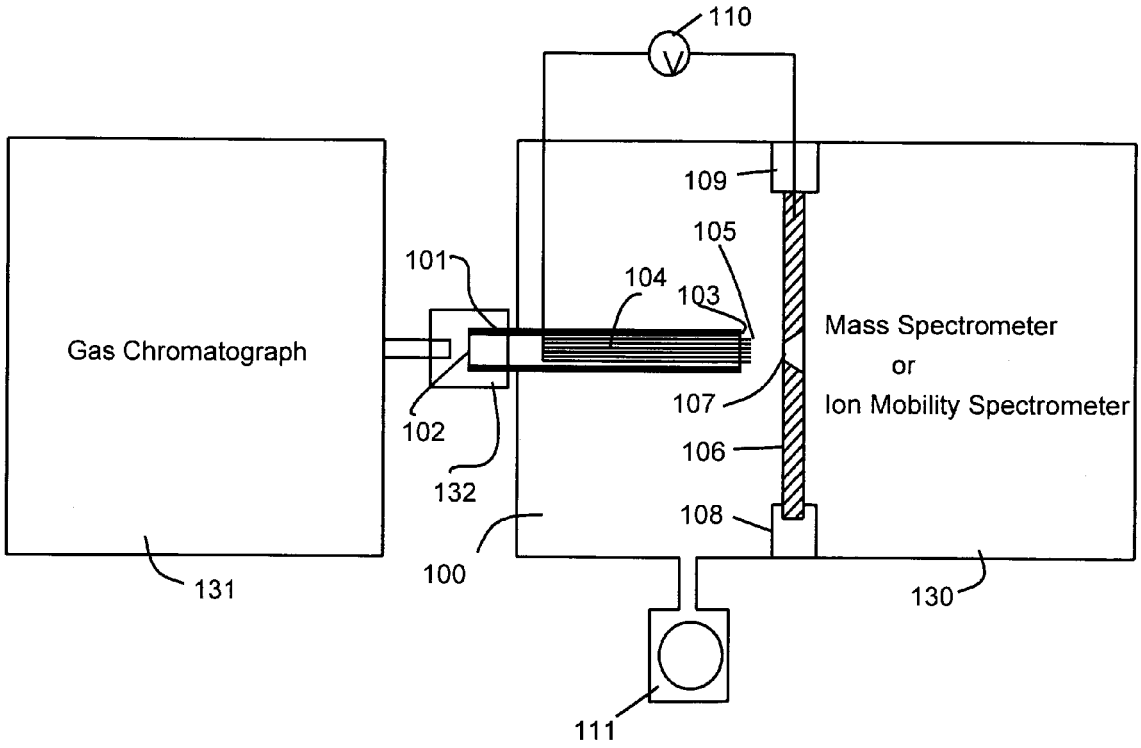
FIG. 4 is a schematic illustration of a corona discharge GC-MS with a multi-threaded corona discharge ionization source provided in accordance with the principles of the present invention.

FIG. 4 shows an exemplary corona discharge ionization source 100 interfaced between GC 131 and mass spectrometer instrument 130. GC 131 is connected to the multi-threaded electrode 104 using an adapter 132. In operation, the elution from GC 131 flows into corona discharge mass spectrometer or ion mobility spectrometer 130 via tube 101. The operation of corona discharge ionization source 101 with respect to mass spectrometer or ion mobility spectrometer 130 may be the same or similar to that described above.

The chemical species utilized for ionization can be gas- or liquid-phases or sampling materials present on an ambient surface in atmosphere. The gas-phase species directly flows from the atmosphere into corona discharge ionization source 100.

Figure 5:
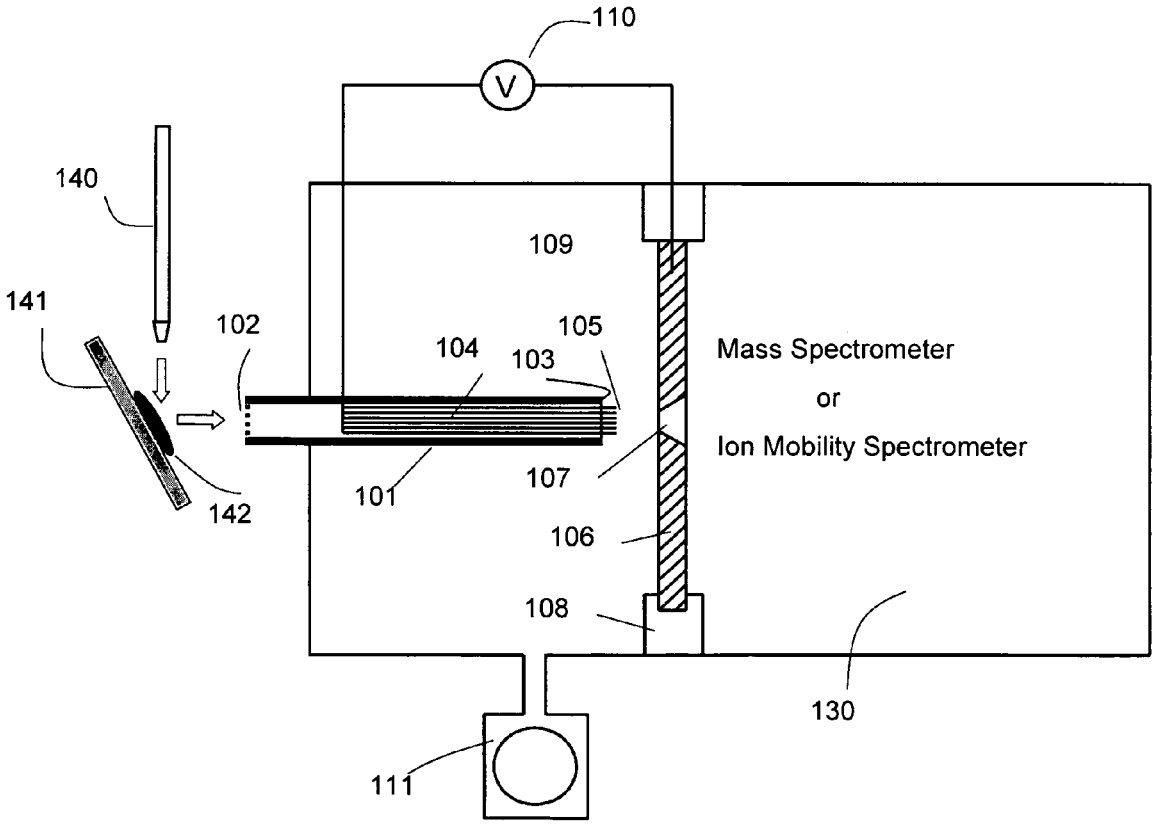
FIG. 5 is a schematic illustration of a corona discharge mass spectrometer or ion mobility spectrometer provided with a multi-threaded corona discharge ionization source and with a pneumatically assisted gas-jet desorption mechanism in accordance with the principles of the present invention.

Liquid-phase sample or sampling materials present on an ambient surface can be evaporated or desorbed into gas-phase by thermal desorption or by pneumatically assisted gas-jet desorption. FIG. 5 shows a multi-thread electrode corona discharge ionization source mass spectrometer or ion mobility spectrometer, which includes an arrangement for pneumatically assisted gas-jet desorption of samples. The arrangement includes a gas jet generator 140 (e.g., a pneumatically-assisted gas spray or a gas nozzle). A gas jet may be pulsed out with a pressure valve such as an electromagnetic valve (not shown). Further, the gas-jet may be heated using a thermal heater with adjustable temperature. Non-volatile or low volatility chemical species sample 142 of interest, e.g. explosives or its residues, may be obtained on a sample-carrying surface 141. The sample-carrying surface can be a conductive (e.g. metal) or an insulator (e.g., polymer) surface. In operation, the sample-carrying surface may be placed near the inlet of tube 101, with the sample facing tube entrance 102. Tube 101 may be made of flexible metallic or insulator material to access a remote target surface. In cases where direct access to a remote target surface 141 is necessary, tube 101 may be as long as a few meters. Similarly, where it is necessary to access a bring-in target surface 141, tube 101 may be as short as a few millimeters in cases.

The surface 141 is oriented towards tube inlet 102. A hot gas-jet from generator 140 is directed to the surface 141. This nebulizing hot gas-jet directly impinges on the chemical species on the sample-carrying surface. As a result, the chemical species are evaporated or desorbed by thermal desorption and pneumatically forced into gas-phase. The desorbed chemical species then can flow into the ionization source 100 through inlet 102 of the tube 101. This arrangement provides easy non-contact and rapid sampling for analysis, and avoids conventional laborious sample preparation requirements for spectrometric analysis.

Figure 6:
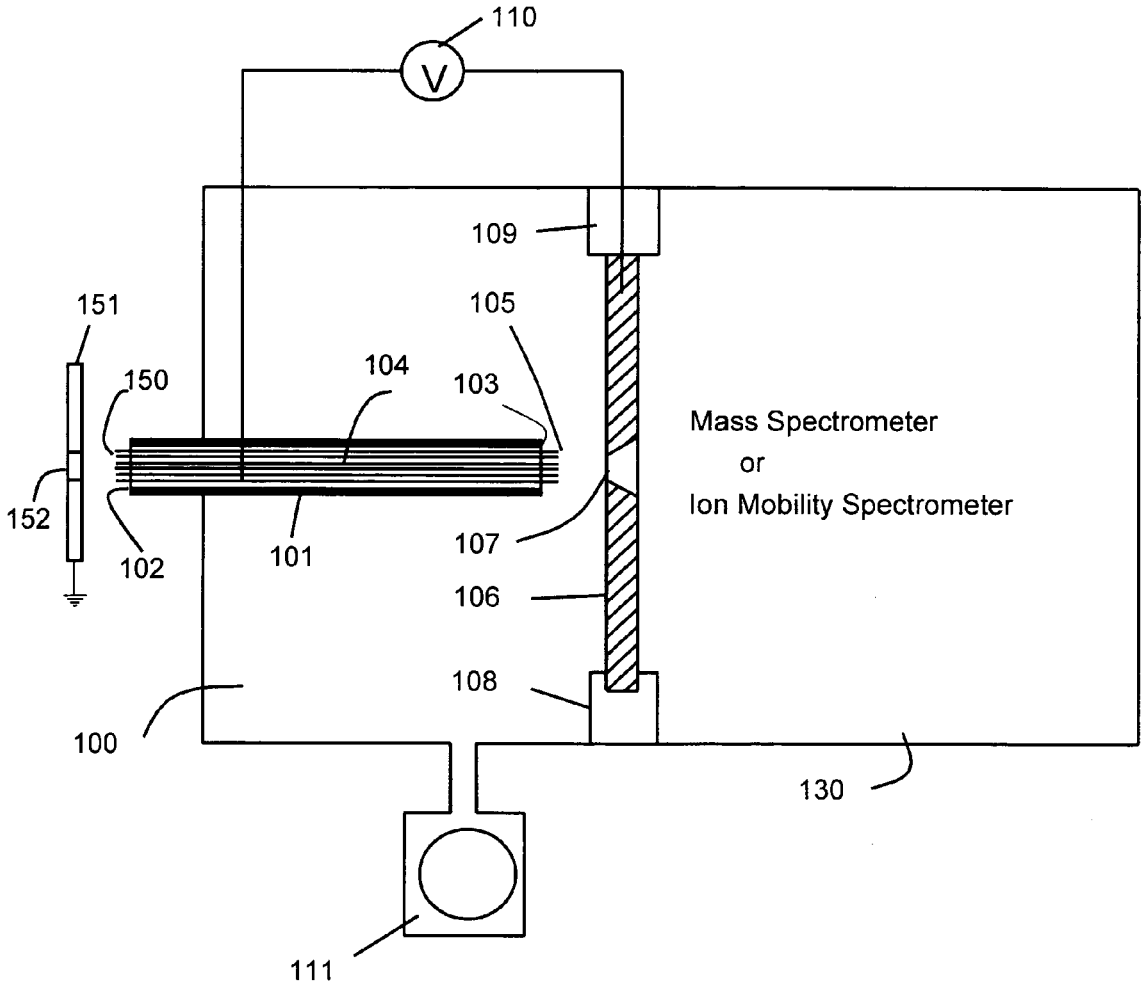
FIG. 6 is a schematic illustration representing the use of a dual multi-threaded corona discharge ionization source in a mass spectrometer (or ion mobility spectrometer) in accordance with the principles of the present invention.

FIG. 6 shows the use of a dual multi-threaded corona discharge ionization source in a mass spectrometer (or ion mobility spectrometer) in accordance with the principles of the present invention. The components of the dual multi-threaded corona discharge ionization source are generally similar to the components of the ionization source 100 shown in FIG. 1. However, in the case of the dual multi-threaded corona discharge ionization source, portions of the multiple threads 105 of electrode 104 also extend through the gas inlet 102 of tube 101. A grounded metallic plane electrode 151 with optional hole 152 is disposed a few millimeters away from the multi-threaded tips 105. In operation, a gas carrying chemical species at atmospheric pressure enters tube 101 into end 102 and flows out of end 103. The gas is first ionized a corona discharge initiated at gas inlet end 102 by applying a voltage between multi thread portions 150 and electrodes 151. A second ionization process occurs at the other end 103 of tube 101, which may be held at atmospheric pressure or low vacuum. It is likely that most of the gas molecules ionized at multi-threaded tips 105 will be neutralized as they travel through tube 101 toward end 102. However, the neutralized molecules can be in a metastable state or excitation states from which they are more easily re-ionized at multi-threaded tips 103. The ionization process by corona discharge multi-threaded tips 103 may be the same as described above with reference to FIGS. 1-5. The two-step ionization processes of the dual multi-threaded corona discharge electrode configuration are likely to enhance overall source ionization efficiency.

In the examples and figures described in the foregoing, multi-threaded electrode 104 is shown as being orthogonal to plane electrode 106 and lying along the central axis of mass spectrometer instrument. It will be understood that this geometrical layout is chosen only for purposes of illustration and convenience in drawing. It will be understood that the multi-threaded electrode may be disposed in any suitable or appropriate geometry for instrument operation. Fore example, the multi-thread electrode may be placed off-axis relative to the center axis of plate 106, or hole 107 or hole and the axis of mass spectrometer instrument 130 as desired. Further, the multi-thread electrode may be placed at any suitable angle relative to mass spectrometer instrument 130. The multi-thread electrode may be perpendicular to the axis of mass spectrometer instrument 130 if so desired. Placement of the multi-thread electrode at an off-axis and/or angled orientation relative to the axis of mass spectrometer instrument 130 can prevent larger ion particles, clusters, and high-energy ions and electrons from reaching the mass analyzer and the ion detector utilized in the spectrometer. Accordingly, such orientations may be advantageously utilized to decrease the noise signals.

Numerous modifications and alternative embodiments of the present invention will be apparent to those skilled in the art in view of the foregoing description. Accordingly, the foregoing description should be construed as illustrative only and is for the purpose of teaching those skilled in the art the best mode for carrying out the present invention. Details of the structure may vary substantially without departing from the spirit of the invention, and exclusive use of all modifications that come within the scope of the invention is reserved by the claims, which follow.

The invention claimed is:

1. A spectrometer instrument comprising a corona discharge ionization source, wherein the corona discharge ionization source comprises:

a multi-thread electrode having multiple discharge tips on one end face; and a plane electrode having a hole.

2. The spectrometer instrument of claim 1 wherein the multi-thread electrode is enclosed in tube.

3. The spectrometer instrument of claim 2 wherein the multi-thread electrode is enclosed in tube held at atmospheric pressure.

4. The spectrometer instrument of claim 2 wherein one end of the tube is held at atmospheric pressure and a second end is disposed in a low vacuum chamber, and wherein the electrode end face having multiple discharge tips is disposed in low vacuum side.

5. The spectrometer instrument of claim 4 wherein the low vacuum side is held at a vacuum ranging from about a few hundred mbar to a few mbar.

6. The spectrometer instrument of claim 2 wherein gas and gas-phase chemical species flows through the tube for being ionized directly by multiply corona discharge tips.

7. The spectrometer instrument of claim 2 wherein the multi-thread electrodes and the tube are heated.

8. The spectrometer instrument of claim 2, which is configured as a corona discharge ion mobility spectrometer.

9. The spectrometer instrument of claim 2, which is configured as a corona discharge quadrupole ion trap mass spectrometer or linear ion trap mass spectrometer.

10. The spectrometer instrument of claim 2, which is configured as a corona discharge quadrupole mass filter.

11. The spectrometer instrument of claim 2, which is configured as a corona discharge linear ion trap mass spectrometer.

12. The spectrometer instrument of claim 2, which is configured as a corona discharge time-of-flight mass spectrometer.

13. The spectrometer instrument of claim 2, which is configured as an ionization source for gas chromatograph-mass spectrometer (GC-MS).

14. The spectrometer instrument of claim 2 further comprising an arrangement wherein liquid-phase sample or sample present on an ambient surface is desorbed into gas-phase by thermal desorption and pneumatic assisted gas-jet desorption and flowed as gas species through the tube and ionized by corona discharge.

15. The spectrometer instrument of claim 2, wherein the multi-thread electrode is disposed in an off-axis orientation relative to the hole in the plane electrode.

16. The spectrometer instrument of claim 2, wherein the multi-thread electrode is disposed in an angled orientation relative to an axis the plane electrode.

17. The corona discharge ionization source of claim 1 wherein each single thread has a diameter in the range of about a micrometer to about a few hundred micrometers.

18. A spectrometer instrument comprising a corona discharge ionization source, wherein the corona discharge ionization source comprises a multi-thread electrode having multiple discharge tips on two end faces.

19. A spectrometer arrangement for analyzing chemical species, the arrangement comprising:

(1) a corona discharge ionization source, wherein the corona discharge ionization source comprises: a multi thread electrode having multiple discharge tips on one end face; and a plane electrode having a hole;

(2) a gas jet assembly configured to desorb chemical species from a sample and place the chemical species in gas phase so that they can be ionized by the corona discharge ionization source; and (3) a spectrometer measurement unit configured to measure properties of ionized chemical species.

* * * * *